US006117057A

United States Patent [19]

Olschansky et al.

[11] Patent Number: 6,117,057

[45] Date of Patent: Sep. 12, 2000

[54] ABDOMINAL EXERCISE SYSTEM

[76] Inventors: Brad Olschansky; Scott Olschansky, both of 2003 Lake Park Dr., Apt. H., Smyrna, Ga. 30080

[21] Appl. No.: 09/157,134

[22] Filed: Sep. 18, 1998

[51] Int. Cl.[7] ..... A63B 26/00

[52] U.S. Cl. ..... 482/140; 482/148; 482/907

[58] Field of Search ..... 482/140, 104, 482/100, 137, 91, 92, 93, 94, 97, 51

[56] References Cited

U.S. PATENT DOCUMENTS

| | | | |
|---|---|---|---|
| D. 349,344 | 8/1994 | Kudlak . | |
| D. 385,929 | 11/1997 | Mishan . | |
| 4,372,553 | 2/1983 | Hatfield . | |
| 5,031,905 | 7/1991 | Walsh . | |
| 5,256,126 | 10/1993 | Grotstein . | |
| 5,300,005 | 4/1994 | Wang . | |
| 5,308,306 | 5/1994 | Wang | 482/142 |
| 5,492,520 | 2/1996 | Brown . | |
| 5,542,898 | 8/1996 | Wilkinson . | |
| 5,545,114 | 8/1996 | Gvoich | 482/140 |
| 5,577,987 | 11/1996 | Brown . | |
| 5,630,778 | 5/1997 | Barreca . | |
| 5,665,041 | 9/1997 | Hsieh . | |
| 5,697,874 | 12/1997 | Abelbeck . | |
| 5,702,334 | 12/1997 | Lee . | |
| 5,728,035 | 3/1998 | Sands | 482/140 |
| 5,746,688 | 5/1998 | Prager . | |

OTHER PUBLICATIONS

AB Ecstasy advertisement (undated).

*Primary Examiner*—Michael A. Brown
*Assistant Examiner*—Lori Baker
*Attorney, Agent, or Firm*—Rosenberg, Klein & Lee

[57] ABSTRACT

There is provided an abdominal exercise system (10) for aiding a user in performing exercises to strengthen and tone his or her abdominal muscles. Abdominal exercise system (10) generally includes a base assembly (100) adapted for angular displacement responsive to a force applied by the user; and, an engagement assembly (150) coupled to the base assembly for transferring the user-applied force thereto. Base assembly (100) includes a pelvic support structure having a substantially planar guide panel portion (130) for supportingly engaging and guiding the user's pelvic region during its angular displacement.

8 Claims, 12 Drawing Sheets

ABDOMINAL EXERCISE SYSTEM

BACKGROUND OF THE INVENTION

1. Field of the Invention

The subject abdominal exercise system is generally directed to a portable exercise system for aiding a user in performing exercises to strengthen and tone his or her abdominal muscles. More specifically, the subject abdominal exercise system is one which enables the user to perform such exercises with optimal efficiency by not only guiding the user's body through essential movements, but by causing the user to maintain proper form throughout the entire cycle of bodily movements in a given exercise.

A marked increase in the general public's attention to physical fitness has been evident in recent years. Along with this newfound enthusiasm, however, comes the ever-increasing likelihood that many individuals will not perform certain exercises properly. There is a heightened probability where an individual is relatively new to specialized physical exercises, or simply new to physically exerting activities, that the individual will not only fail to realize the full benefits of a given exercise, but may actually suffer physical injury. This is especially so in the many cases where the individual engages in unsupervised exercise within the confines of his or her own home.

Particular classes of exercises, either by virtue of the bodily positions they entail or by virtue of the stress they cause on certain vulnerable parts of the user's body, are particularly difficult to perform. What is more, the potential consequences of their improper performance are particularly severe. One such class of exercises includes exercises such as sit-ups designed to strengthen and tone an individual's abdominal muscles. A strong abdominal region is essential for overall physical fitness given that strong abdominal muscles tend to alleviate the stress/load to be borne by other portions of an individual's body, such as the lower back. Ironically, with abdominal exercises, however, such popular exercises as sit-ups keenly expose to potential injury the very portions—such as the lower back—that would most directly benefit from a strengthened abdominal region. The nature of bodily movements required by such exercises and the unrestrained bodily contortions they permit combine to yield a serious potential for injury.

To avoid this heightened threat of injury, many engage alternatively in a family of exercises popularly referred to as "abdominal crunch" exercises. In those exercises, the user generally lays on his or her back on a support surface, with the knees and/or feet elevated. The user then essentially 'curls' his or her abdominal region to draw the upper body region and the knees closer together, then 'uncurls' to complete an exercise movement cycle.

While the potential benefits of these abdominal crunch exercises (and variations thereof) are well established, they, too, are problematic for a number of reasons. First, the bodily positions that the exercises require of an individual are sufficiently difficult to maintain to cause even the most disciplined of individuals to initially assume, let alone maintain proper form throughout the entire cycle of the exercise. Yet, so maintaining proper form is precisely what is necessary if the exercise is to serve its intended purpose by any significant measure.

Another problematic point with this family of exercises is the acute stress that could be placed on particular vulnerable parts of an individual's body. If not properly performed in a smooth curling, or rolling, action, harmful pressure may be placed, for instance, on points along the individual's spine, especially the lower back.

In view of these and other factors, a device simple and inexpensive enough to be made readily available to the public is needed to cause an individual to perform abdominal crunch-type exercises properly. Such a device must precisely isolate for exercise the muscles of a user's abdominal region.

2. Prior Art

Exercise devices for aiding a user in performing abdominal exercises are known in the prior art. The best prior art known to Applicant includes U.S. Pat. Nos. 5,577,987; 5,492,520; 5,728,035; 5,256,126; 5,542,898; 5,300,005; 5,031,905; 4,372,553; 5,746,688; 5,702,334; 5,698,874; 5,308,306; and, 5,665,041.

Such devices known in the prior art include portable devices which employ a frame within which a user positions the upper portion of his or her body while assuming the necessary exercise position. A curvature or other formation in the frame enables it to be displaced in a rolling motion to lead the user in the performance of an abdominal crunch exercise. While some such devices provide a support member for urging the user's head upward responsive to the frame's rocking motion in a forward direction, no device heretofore known provides any adequate means for maintaining the user's other bodily parts in proper form during the exercise.

SUMMARY OF THE INVENTION

A primary object of the present invention is to provide an abdominal exercise system for aiding a user to properly perform an exercise for strengthening and toning abdominal muscles.

It is another object of the present invention to provide an abdominal exercise system for enabling a user to maintain proper form during the performance of an abdominal crunch type exercise.

It is another object of the present invention to provide an abdominal exercise system for aiding a user to maintain the proper form of his or her lower body portions during the performance of a reverse abdominal crunch exercise.

It is yet another object of the present invention to provide an abdominal exercise system which is readily adaptable to a user's unique bodily dimensions.

It is another object of the present invention to provide an abdominal exercise system which is both portable and collapsible for convenient storage.

It is another object of the present invention to provide an abdominal exercise system which effectively isolates for exercising the muscles of a user's abdominal region.

It is still another object of the present invention to provide an abdominal exercise system which is both simple in structure and operation and inexpensive to manufacture.

These and other objects are attained in the abdominal exercise system of the present invention. The subject abdominal exercise system generally comprises a base assembly adapted for angular displacement responsive to a predetermined force applied to the system by a user and an engagement assembly coupled to the base assembly for transferring thereto the predetermined force applied by the user. The base assembly includes a pelvic support for supportingly engaging and guiding the user's pelvic region during the base assembly's angular displacement. The pelvic support is formed with a substantially planar guide panel portion.

DETAILED DESCRIPTION OF THE PREFERRED EMBODIMENTS

Figure 1:
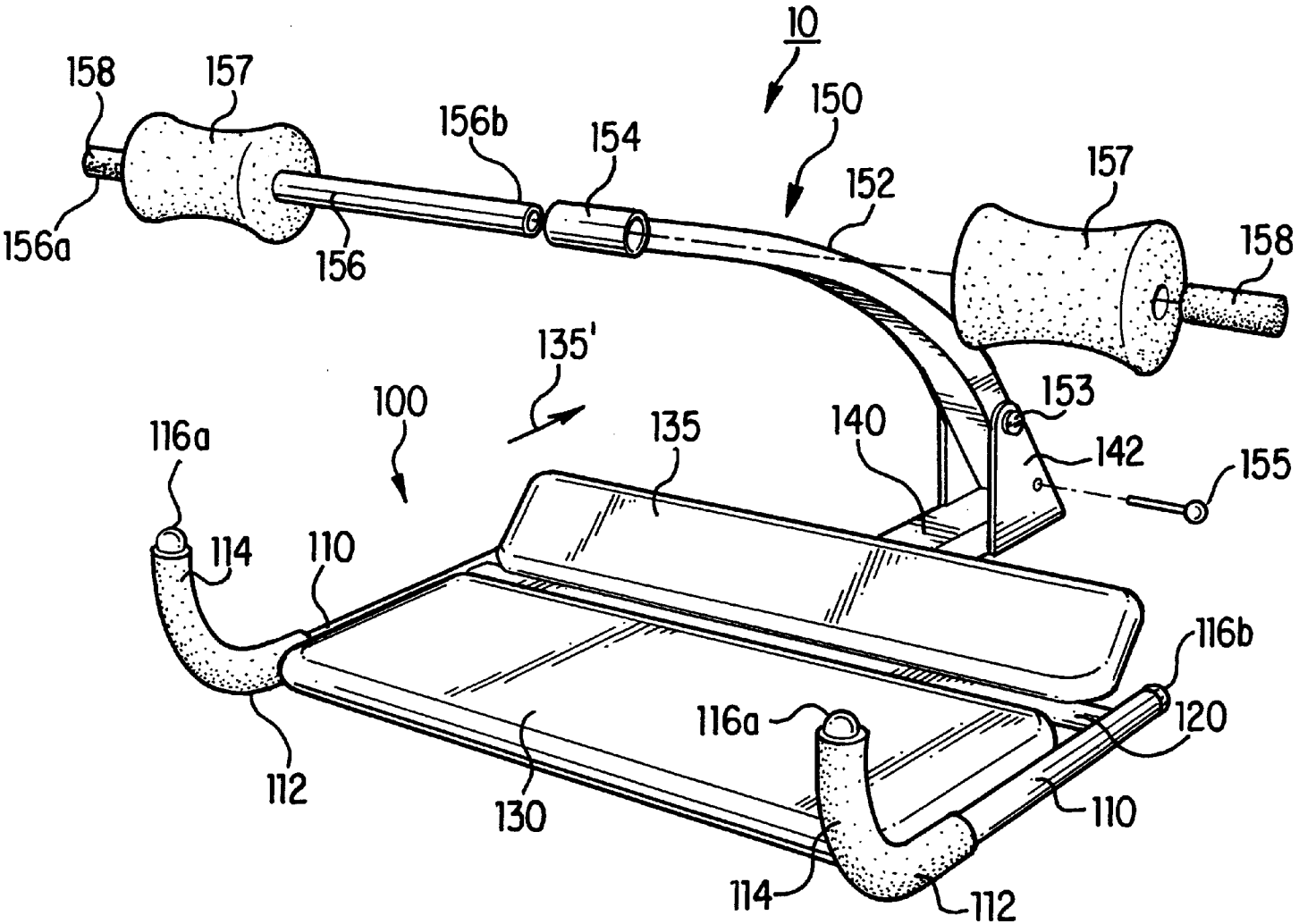
FIG. 1 is a partially exploded perspective view of a first embodiment of the present invention.

Referring now to FIG. 1, there is shown a first embodiment of the subject abdominal exercise system. Abdominal exercise system 10 generally includes a base assembly 100 and an engagement assembly 150 coupled thereto. Base assembly 100 is configured such that it may be angularly displaced responsive to a user's movements in performing an abdominal crunch type exercise therewith. Accordingly, base assembly 100 is preferably formed with a frame structure having a pair of substantially parallel support members 110 coupled together by a cross beam member 120. Base assembly 100 also includes an extension member 140 extending transversely from an intermediate portion of cross beam member 120. Given its function and operation, it is important that base assembly 100 be generally of sufficient strength and rigidity to displace angularly substantially as one unit; hence, each support member 110 is formed, as are cross beam member 120 and extension beam member 140, of a material containing metal, dense plastic, or the like.

In the embodiment shown, each support member 110 is preferably formed with an arcuate elbow portion 112 about which the angular displacement of base assembly 100 occurs. While elbow portions 112 enable a rolling or rocking motion that facilitates a smooth angular displacement of system 10 during use, they may or may not be present in other embodiments. They may also be replaced in some embodiments with comparable portions which are not of 'elbow' configuration, but are nevertheless formed with arcuate surfaces for contacting an underlying surface.

In the embodiment shown, each support member 110 is formed with a tubular contour. So as to protect a user from any sharp edges, a pair of rounded caps 116*a*, 116*b* are preferably coupled to the opposing ends of each support arm 110. A sleeve 114 formed preferably of a dense foam or other suitable material is fitted about elbow portion 112 of each support arm 110 to both cushion the portion for engagement by the user and enable the elbow portion 112 to obtain non-damaging traction on the underlying surface.

Base assembly 100, in accordance with the present invention, also includes a pelvic support having guide panel 130 coupled to and extending between support members 110. The pelvic support serves, effectively, to 'cradle' the user's pelvic region during the given exercise. Guide panel 130 specifically serves to engage and push against the user's pelvic region in this process. Accordingly, guide panel 130 is preferably formed of a substantially rigid material such as wood, metal, or plastic; and, is preferably covered, at least at its exposed portions, with a suitable cushioning material. Guide panel 130 may even be formed in other embodiments of a non-rigid material, so long as suitable means are employed to enable the material to provide a sufficient level of user-support (for example, by taut extension across the assembly). The particular composition and construction chosen for guide panel 130 is not important to the invention.

Preferably, an inclined stop panel 135 is coupled to cross beam member 120 such that it is disposed adjacent guide panel 130. Stop panel 135 serves to limit the displacement of the user's pelvic region relative to base assembly 100 in the direction indicated by directional arrow 135'. As such, stop panel 135 is also formed in the embodiment shown of a substantially rigid material, and is preferably covered at its exposed surfaces by a suitable cushioning material. Like guide panel 130, however, stop panel 135 may in other embodiments, be formed of other suitable material compositions, with other suitable structural configurations.

System 10 also includes an engagement assembly 150 adjustably coupled to base assembly 100. Engagement assembly 150 includes a suspension arm member 152 having a lower portion that, preferably, is pivotally coupled by a pivot pin 153 to an anchoring structure 142 of extension member 140. This pivotal coupling enables suspension arm member 152 to be collapsed against base assembly 100 when system 10 is not in use. During use, however, suspension arm member 152 is locked in its suspending position by the passage therethrough of a locking pin 155 which prevents its movement relative to anchoring structure 142.

Though engagement assembly 150 may in other embodiments be formed in non-collapsible form, collapsibility provides for extremely convenient storage and ready portability. Such collapsibility may be realized in any suitable manner. In addition to the coupling of relatively displaceable structural members, for instance, collapsibility may be realized through the use of flexible or otherwise deformable elements.

The free end of suspension arm member 152 has formed thereon a tubular coupling portion 154 through which an engagement bar 156 is coaxially passed. Engagement bar 156 is of sufficient length such that when it is inserted through coupling portion 154, enough of its length extends from either axial end of coupling portion 154 to form engagement rod portions 156*a*, 156*b* that may comfortably be engaged by both of the user's knees/thighs. Preferably, a pair of cushioning sleeves 157 are inserted about the intermediate portions of engagement bar 156 extending from coupling portion 154 for engagement by the user's knees. A secondary pair of thin cushioning sleeves 158 are fitted about the terminal end portions thereof for manipulation by the user should hand assist be necessary to complete a given exercise movement.

In alternate embodiments, engagement bar 156 and suspension arm member 152 may be integrally formed. In the embodiment shown, however, they are separately formed for manufacturing simplicity. The approach chosen is not important to the present invention.

Also in alternate embodiments, one or more portions of engagement assembly 150 may be adapted for engagement by parts of the user's body other than his/her knees or thighs. As either a supplement or alternative to the engagement assembly portions shown in embodiments disclosed herein, the given engagement assembly may thus include a strap or belt by which base assembly 100 is secured to the user for displacement responsive to his/her exercise movements.

Like the frame components of base assembly 100, engagement bar 156 and suspension arm member 152 are formed of a material having sufficient strength and rigidity to enable the structural integrity of system 10 to be maintained during use. Both engagement bar 156 and suspension arm member 152 are formed preferably of a metallic material having a tubular construction.

During use, a user situates himself/herself relative to system 10 such that his/her pelvic region rests on guide panel 130 and the outer portions of his/her knees/thighs abut the two cushioned portions 157 of engagement bar 156. So situated, the user reclines such that his/her back is resting on the underlying support surface. The user may then perform a typical abdominal crunch type exercise by drawing his/her knees towards his/her upper body portion. Engagement assembly 150 transfers the force applied by the user's knees/thighs thereagainst to extension arm 140 of base assembly 110. This causes extension arm 140 to lift off the underlying support surface such that the entire base assembly 100 begins to displace angularly in a rolling action about elbow portions 112 of support members 110. As this rolling action occurs, guide panel 130 engages and applies a lifting pressure against the user's pelvic region. Inclined stop panel 135 serves to retain base assembly 100 in place relative to the user's back side. The proper curling action of the user's abdominal region is thus effected by system 10.

Figure 2:
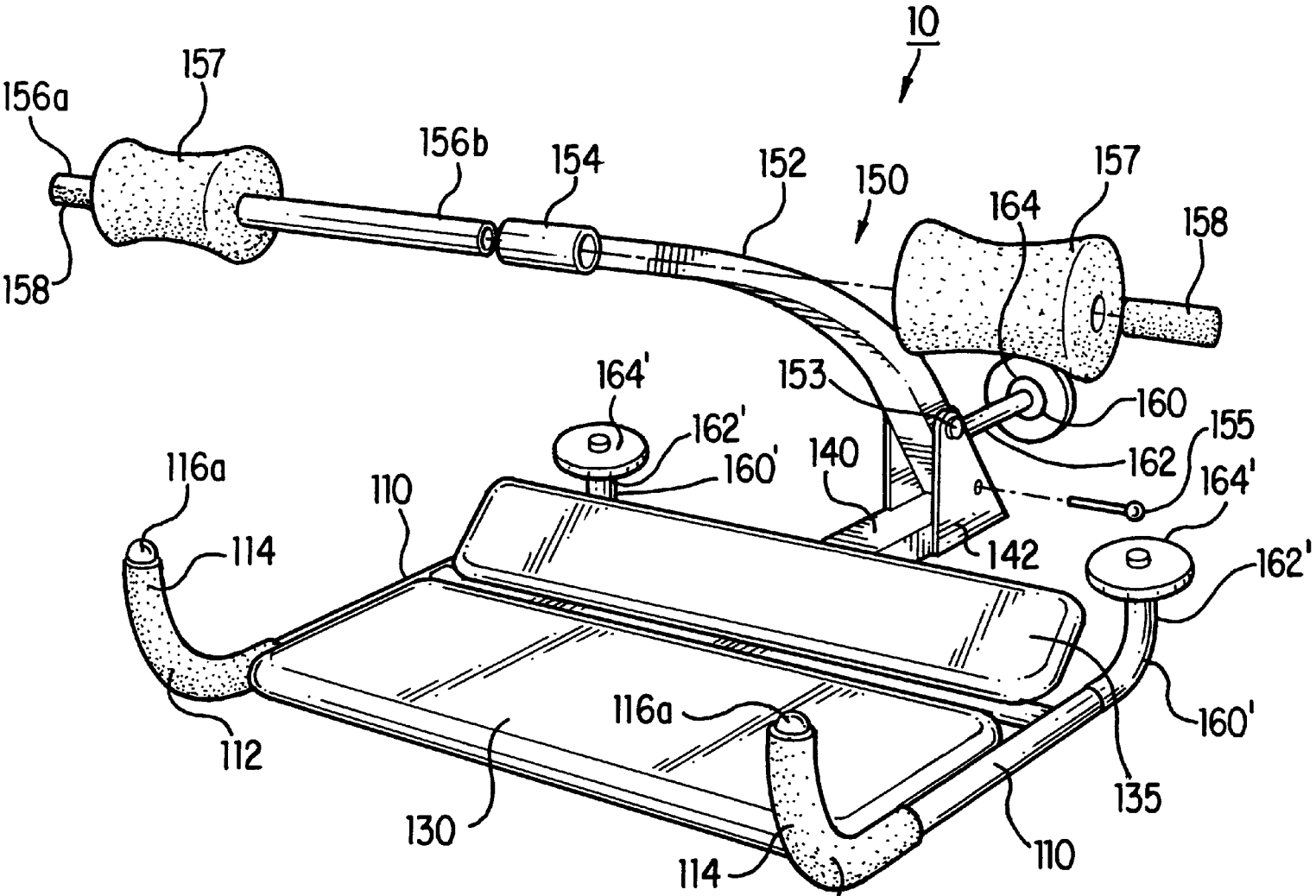
FIG. 2 is a partially exploded perspective view of the first embodiment of the present invention shown with a weight augmentation mechanism coupled thereto at alternative locations.

Referring now to FIG. 2, the first embodiment of the subject abdominal exercise system 10 of FIG. 1 is shown with weight augmentation mechanisms 160 and 160' coupled to alternative points of system 10. Whether it is attached to suspension arm member 152 or at an end of each support member 110, weight augmentation mechanism 160, 160' includes an attachment post 162, 162' to which one or more weights 164, 164' may be releasably coupled. The attached weights 164, 164' simply loads system 10 to increase the resistance that the user must overcome to angularly displace it. This renders the exercise more rigorous.

Note that in alternate embodiments, the weight augmentation mechanism 160, 160' shown may be replaced by other mechanisms for providing such resistive force. For instance, one or more resilient members may be coupled between a portion of system 10 and an anchoring point fixed relative to the underlying support surface to bias system 10 against displacement.

Figure 3:
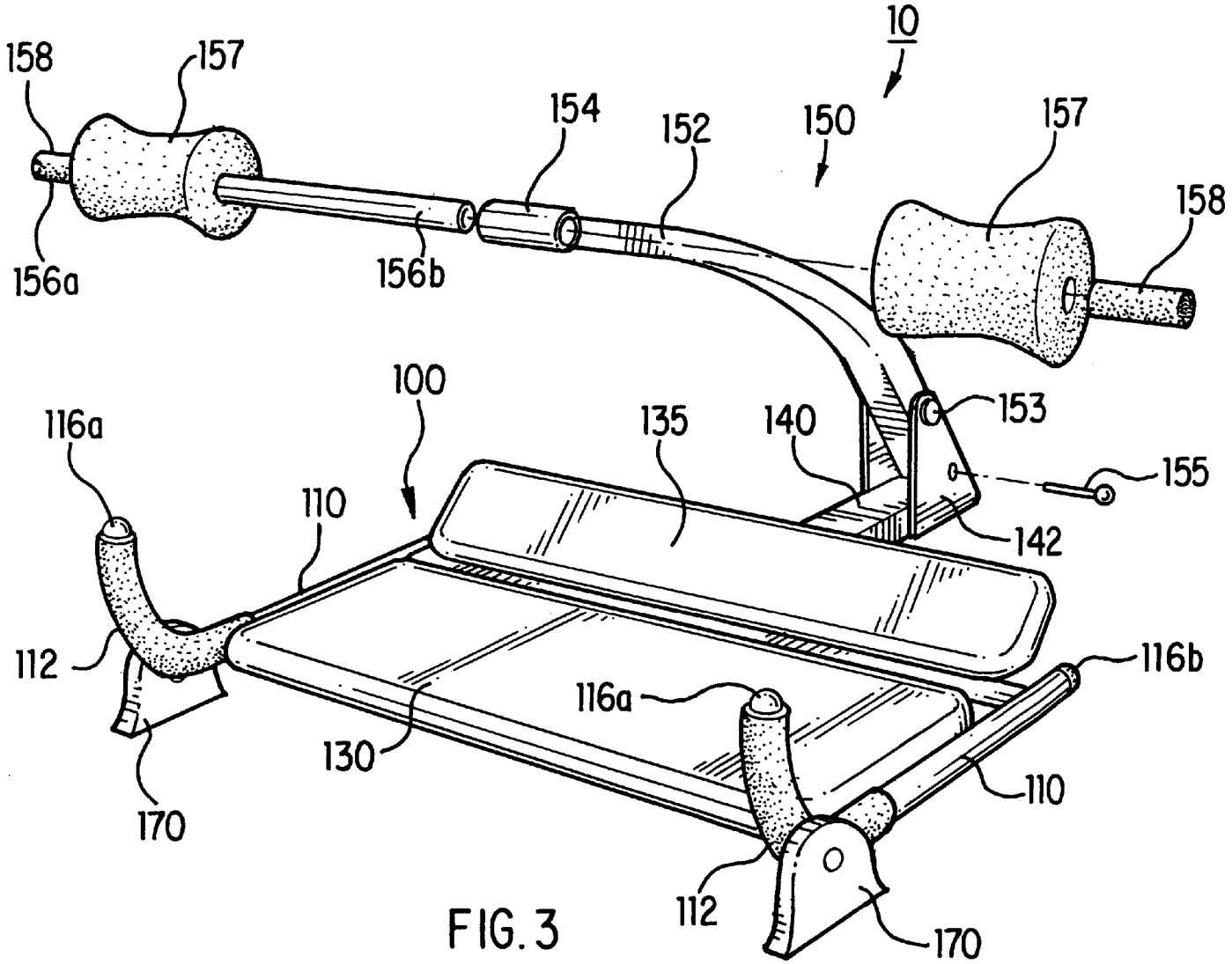
FIG. 3 is an exploded perspective view of the first embodiment of the present invention shown with a pivotal support mechanism coupled thereto.

Turning now to FIG. 3, the first embodiment of the subject abdominal exercise system 10 is shown with a pivotal support mechanism for pivotally suspending and supporting elbow portions 112 of support members 110. Pivotal support mechanism is formed in the embodiment shown by a pair of pivot stands 170 to which elbow portions 112 are coupled by the respective passage of pivot pins therethrough. As long as the dimensions of stands 170 are such that elbow portions 112 of support members 110 are suspended above the underlying support surface by a nominal distance, the exercise movements required of the user are significantly affected only to the extent that the rocking action of base assembly 100 is caused to occur about a fixed pivot axis. This embodiment lessens the system's reliance upon a smooth, consistent underlying support surface and a precise, or even configuration of elbow portions 112 for proper operation.

Figure 4:
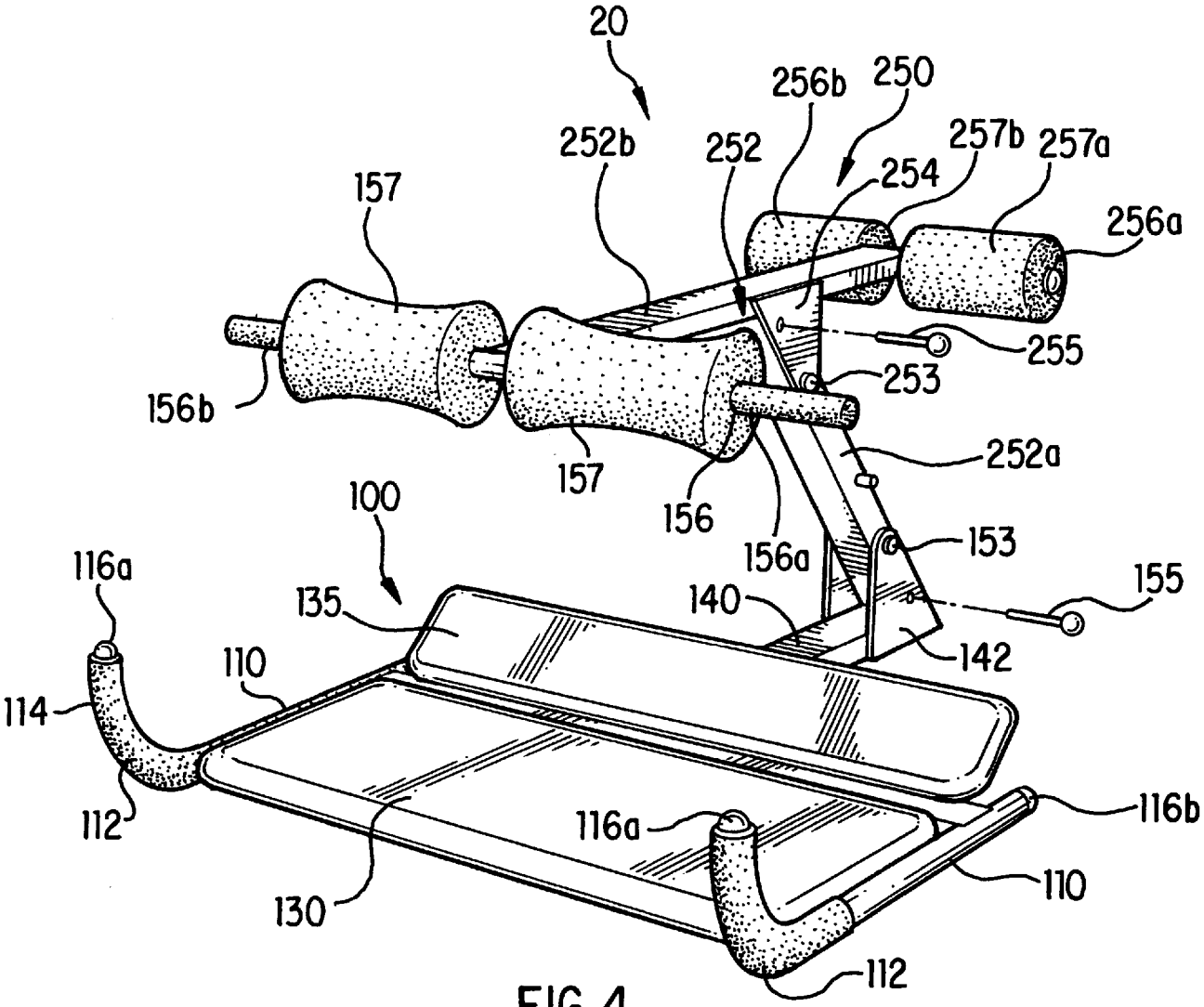
FIG. 4 is a partially exploded perspective view of a second embodiment of the present invention.

Referring to FIG. 4, there is shown an alternate embodiment of abdominal exercise system 20. Within this and other Figures, like reference numbers denote like elements. In this alternate embodiment, system 20 comprises an engagement assembly 250 having a suspension arm structure 252 formed by a first suspension arm section 252*a* and a second suspension arm section 252*b*. First suspension arm section 252*a* is pivotally coupled in locked manner to anchoring structure 142 by pivot and locking pins 153, 155, as in the embodiment of FIG. 1. Second suspension arm section 252*b* is pivotally coupled in releasably locked manner to the top end of first suspension arm section 252*a* by pivot and locking pins 253, 255. To facilitate this coupling, second suspension arm section 252*b* is formed with an anchoring structure 254.

When locked in position for use, second suspension arm section 252*b* is disposed to extend in transverse manner relative to first suspension arm section 252*a*. In addition to the knee- or thigh-engaging portions 156*a*, 156*b* of engagement bar 156 extending from its forward end, second suspension arm section 252*b* includes a pair of supplementary engagement bar portions 256*a* and 256*b* extending from its opposing back end. Supplementary engagement bar portions 256*a*, 256*b* which are, preferably, at least partially covered by respective cushioning sleeves 257*a*, 257*b*, serve as feet engagement bars.

The structure of engagement assembly 250 in this embodiment aids the user in safely maintaining proper form while performing an exercise highly challenging in that regard. During use, the user's knees/thighs engage bar portions 156*a*, 156*b* from behind or below, as with the embodiment of FIG. 1. The user then rests his or her feet (or ankles/lower calf areas) on supplemental engagement bar portions 256*a*, 256*b*. The resulting leg position may then be maintained throughout the progression of the given exercise.

Note that in an alternate use of abdominal exercise system 20, the user may simply engage supplemental engagement bar portions 256*a*, 256*b* from below with his or her feet. That is, the user may hook his/her feet about supplemental engagement portions 256*a*, 256*b*, to retain the resulting leg position throughout the exercise.

When abdominal exercise system 20 is not in use, engagement assembly 250 may be collapsed, as in the first embodiment. The user would simply remove locking pins 155 and 255 and appropriately pivot the respective suspension arm sections 252*a*, 252*b* towards and against base assembly 100.

The multi-suspension arm embodiment of engagement assembly 250 shown in FIG. 4 (and embodiments shown in other Figures) may be realized in other embodiments employing various alternative configurations of suspension arm sections 252*a*, 252*b*. Although not shown, suspension arm sections 252*a*, 252*b*, in one alternative embodiment, may be arranged in substantially a "V" configuration, with each suspension arm section 252*a*, 252*b* having an end portion pivotally coupled in releasable locked manner to anchoring structure 142. The respective free end portions of arm sections 252*a*, 252*b* would then flare outward to form substantially a "V." Cushioned engagement bar portions extending from those free ends of suspension arm sections 252*a*, 252*b* would provide engagement points for the user.

Such variations in the configuration of engagement assembly 250 in this and other embodiments shown herein are fully realizable without departing from the scope of the present invention.

Figure 5:
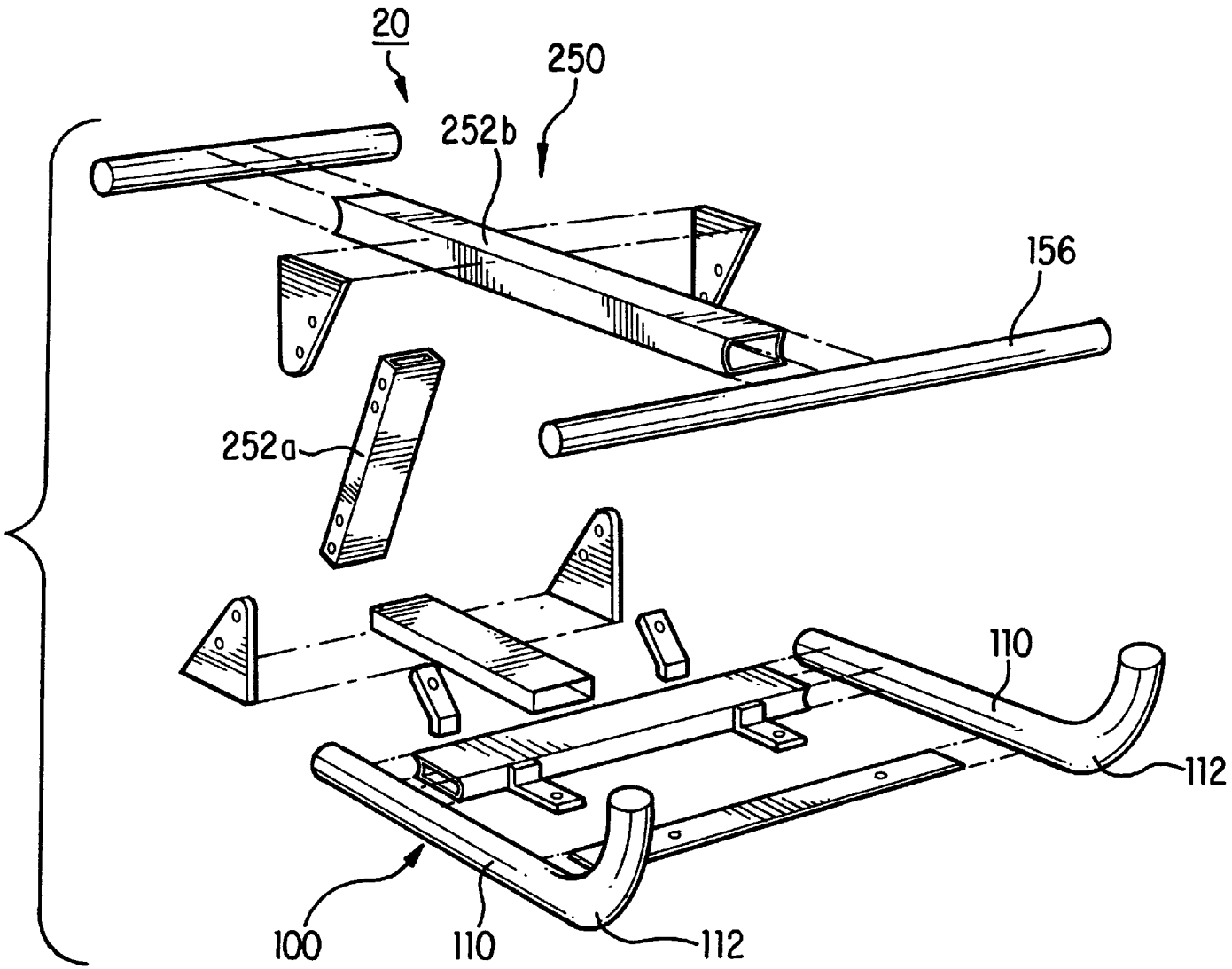
FIG. 5 is an exploded perspective view of a portion of the second embodiment of the present invention.

Referring to FIG. 5, there is shown an exploded perspective view of the system's skeletal frame structure. In the embodiment shown, the skeletal frame structure of abdominal exercise system 20 may be formed by assembling together structural members separately fabricated from a steel or like material. The members may be fastened together, then, by welding or by use of suitable fasteners. The actual configuration of individual structural members or their respective dimensions and configurations are not important to the present invention, except to the extent noted herein.

Figure 6:
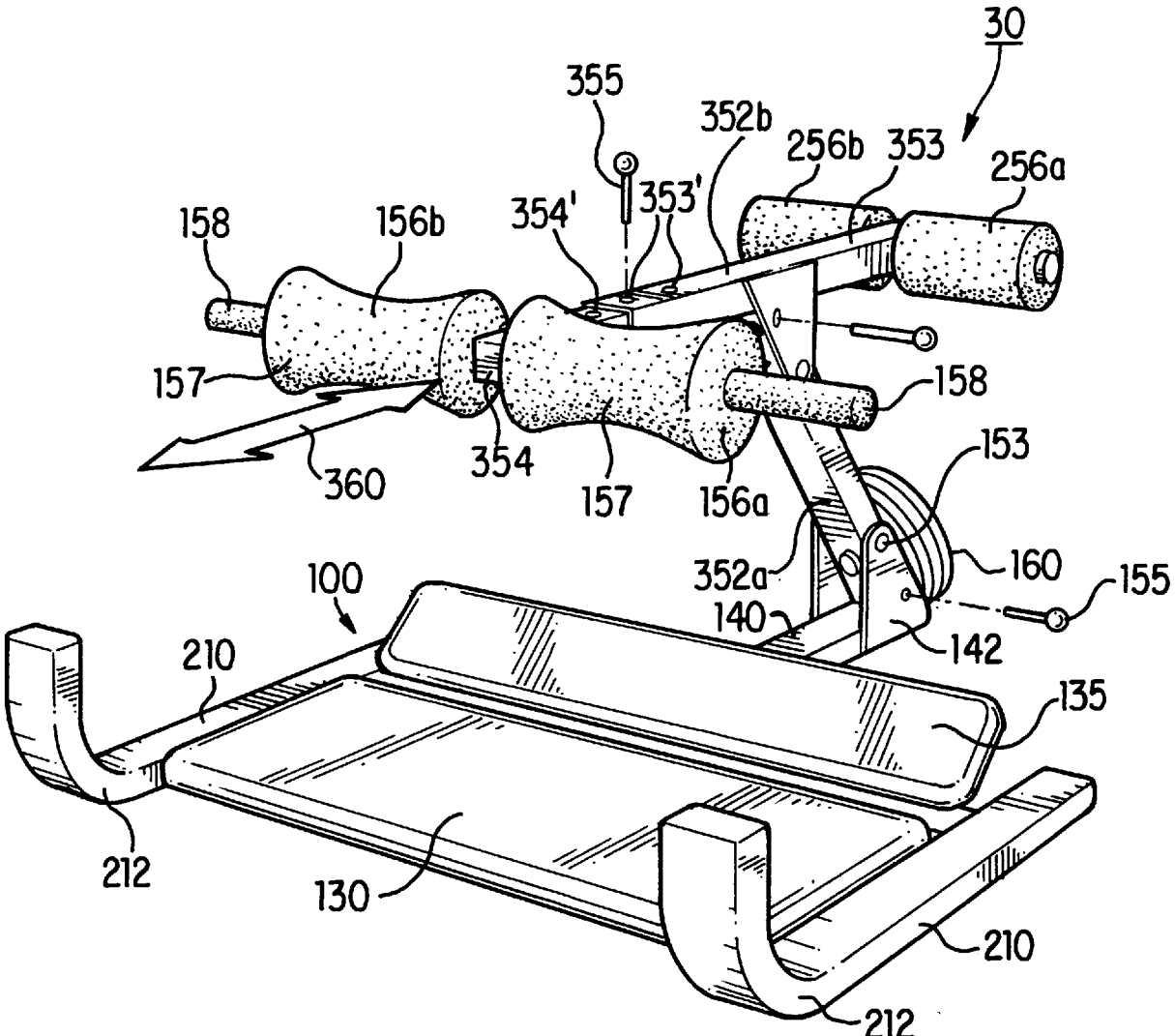
FIG. 6 is a partially exploded perspective view of a third embodiment of the present invention.

Turning now to FIG. 6, there is shown another alternate embodiment of the subject abdominal exercise system. Exercise system 30 in this embodiment is similar to system 20 shown in the embodiment of FIG. 4. Abdominal exercise system 30 includes first and second suspension arm sections 352*a*, 352*b* comparable to first and second suspension arm sections 252*a*, 252*b*, except that second suspension arm section 352*b* is formed by telescopically coupled outer and inner portions 353, 354. Outer and inner portions 353, 354 respectively include coupling holes 353', 354' which may be aligned to receive a locking pin 355 therethrough, but at least one of the outer and inner portions 353, 354 includes a plurality of such coupling holes 353', 354' linearly displaced therealong. Inner portion 354 may then be telescopically displaced relative to outer portion 353 along the directions indicated by bidirectional arrow 360. Once inner portion 354 is displaced relative to outer portion 353 to sufficiently position engagement bar portions 156*a*, 156*b* from supplemental engagement bar portions 256*a*, 256*b*, the appropriate pair of coupling holes 353', 354' may be aligned and locking pin 355 inserted therethrough to lock the configuration of second suspension arm section 352*b*. This enables suspension arm section 352*b* to be adjusted in length to suit the given user's unique bodily dimensions.

Another modification incorporated into system 30 is the configuration of support members 210. While still formed with an arcuate elbow portion 212, each support member 210 is formed with a rectangular cross-sectional contour extended laterally in dimension. This makes for a more stable contact with the underlying support surface. Also, system 30 is shown with a weight augmentation mechanism 160 installed on first suspension arm section 352*a*.

Figure 7:
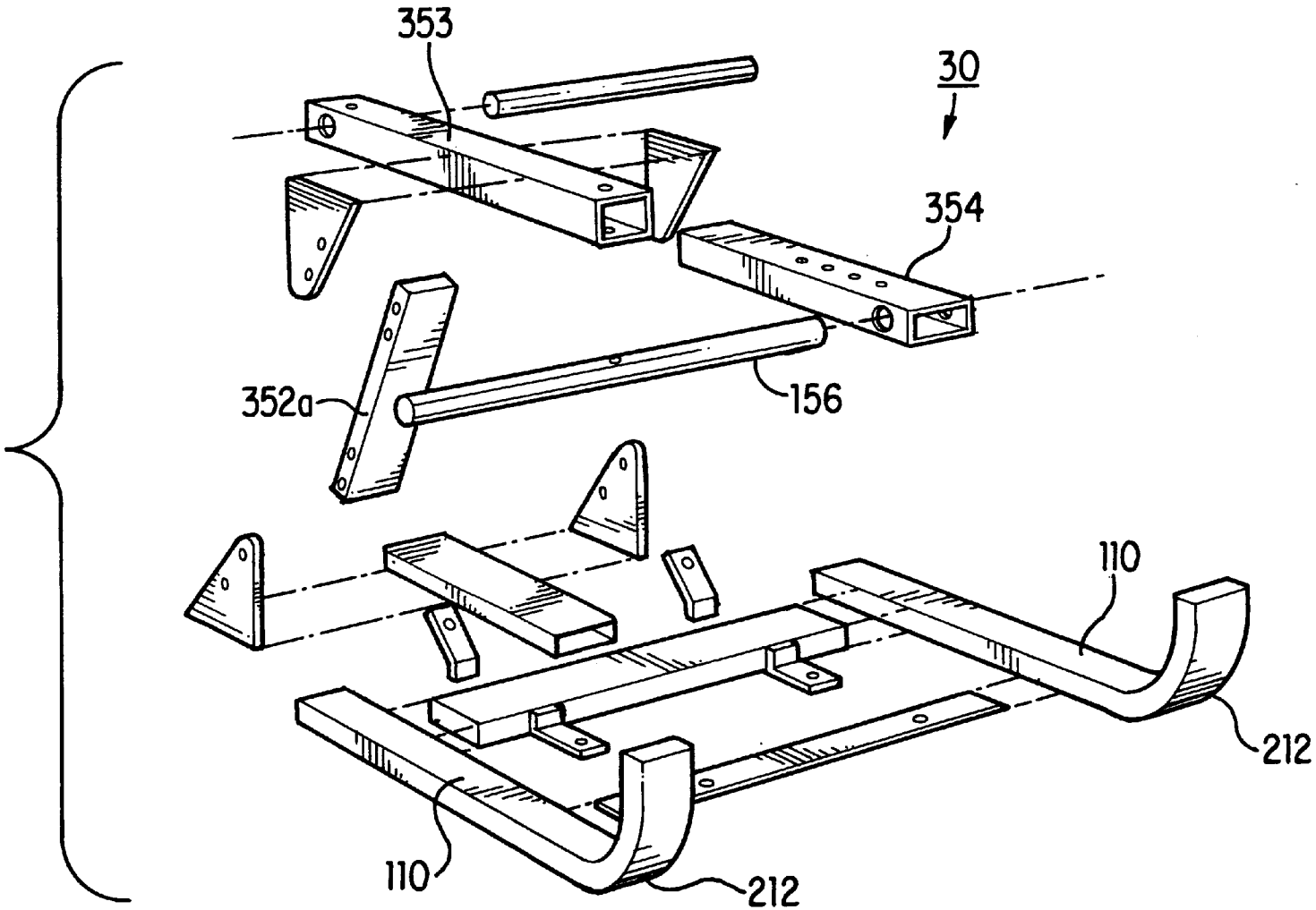
FIG. 7 is an exploded perspective view of a portion of the third embodiment of the present invention.

FIG. 7 shows an exploded view of an exemplary frame structure that may be employed to realize abdominal exercise system 30. As with the exemplary structure shown in FIG. 5, this structure is but one example of numerous structures that may be employed, and the particular configuration and dimensions of individual structural members are not important to the present invention, except to the extent noted herein. In an alternate embodiment, portions of the resulting frame structure, or combinations thereof, may be integrally formed, for instance, as a molded plastic structure.

Figure 8:
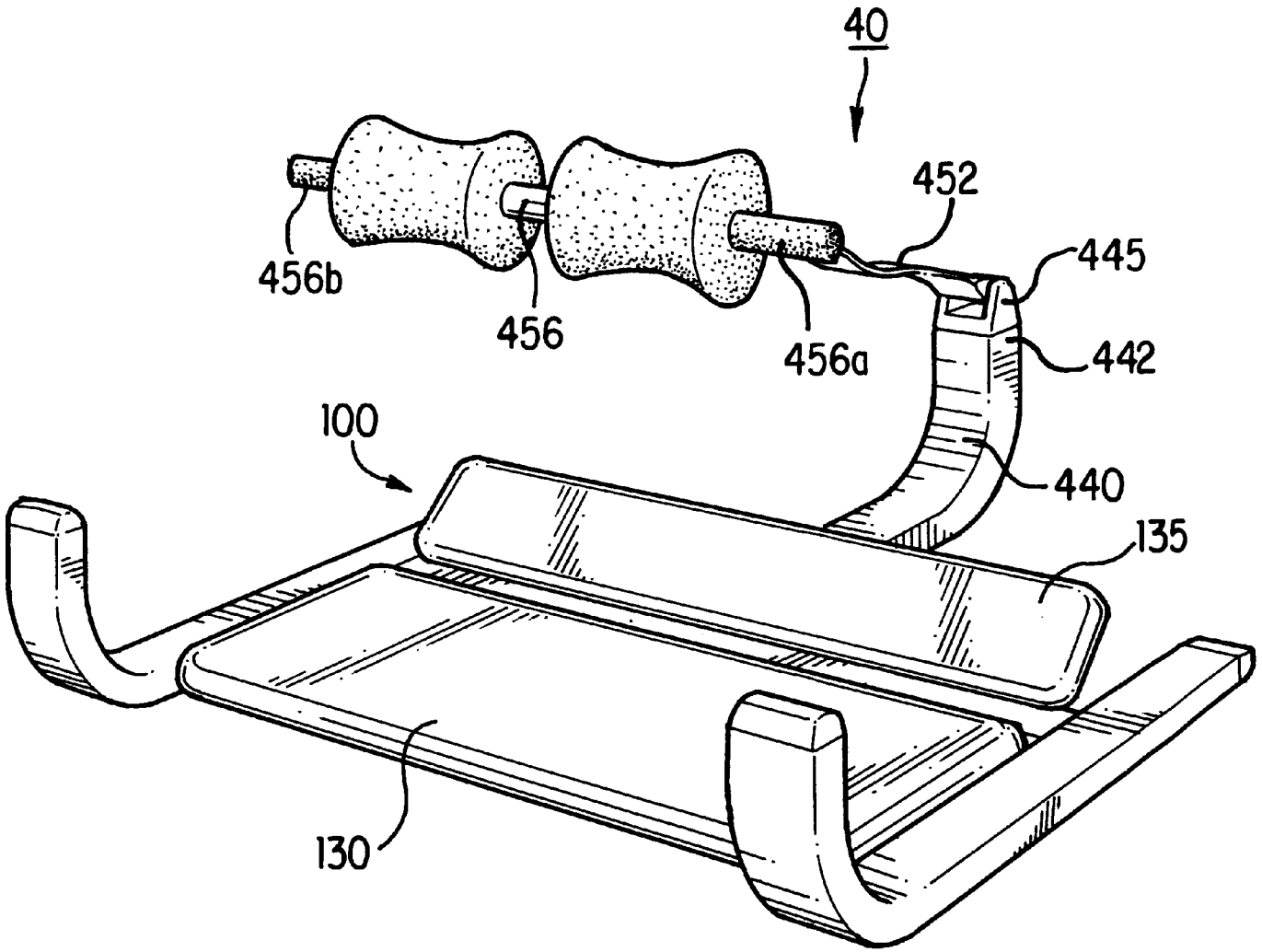
FIG. 8 is a perspective view of a fourth embodiment of the present invention.

FIG. 8 is yet another alternate embodiment of the subject abdominal exercise system. Exercise system 40 in this embodiment includes a base assembly having an extension member 440 configured to terminate at a raised terminal portion 442. An anchoring portion 445 is either coupled to this raised terminal portion 442, or formed as an integral part thereof. System 40 includes an engagement bar 456 having engagement bar portions 456*a*, 456*b* adapted, as in the embodiments described above, to engage the user's knees. Engagement bar 456 is coupled in this embodiment to anchoring portion 445 by a flexible coupling member 452. Flexible coupling member 452 may be formed by a flexible strap or cord of sufficient strength to withstand the tension typically applied thereto during use of the system. Flexible coupling member 452 may also be formed of a material having a predetermined resilience, so long as the material's resilience is not so great as to preclude all angular displacement of the given base assembly responsive to a displacement force applied by a user on engagement bar portions 456*a*, 456*b*.

Figure 9:
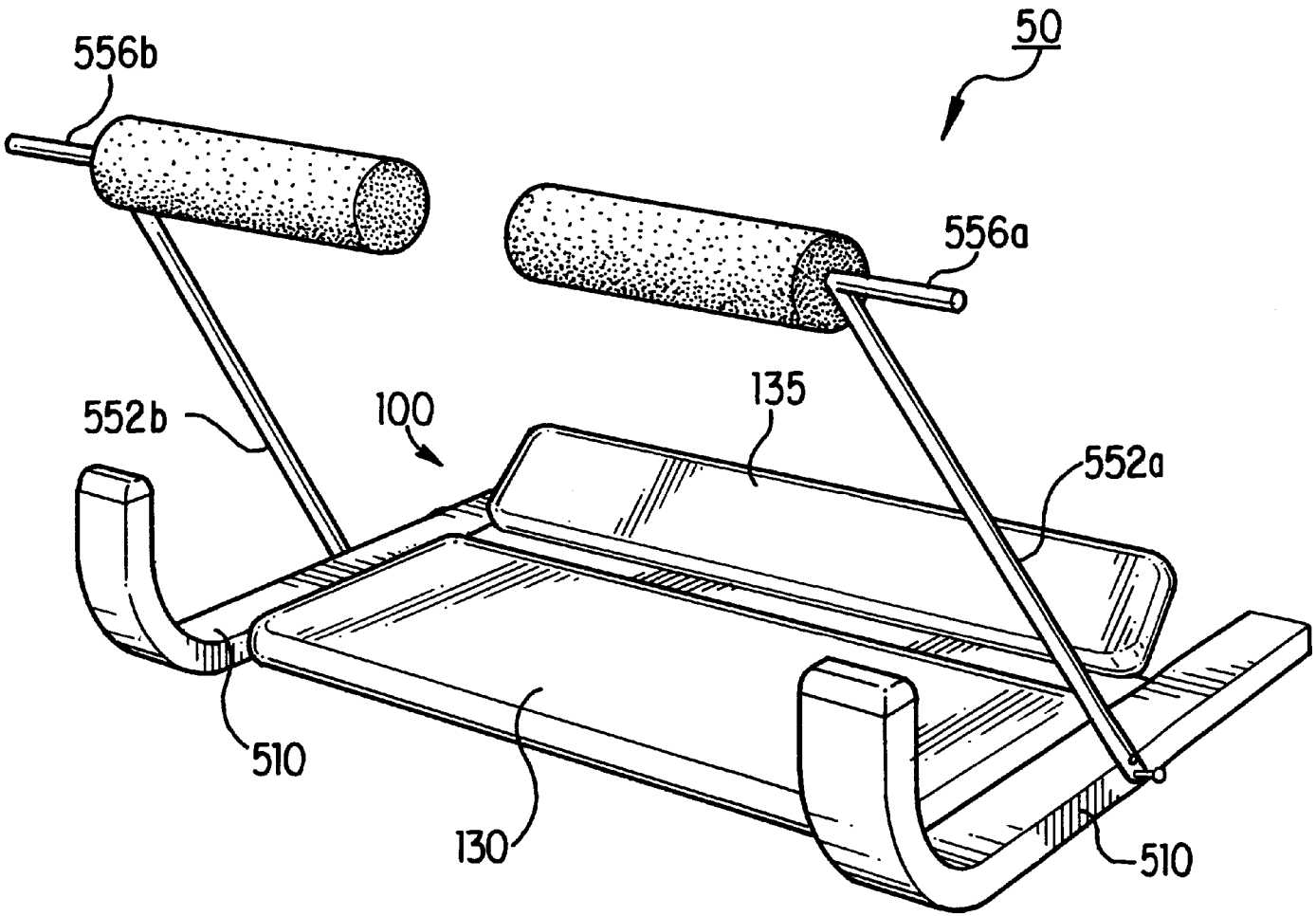
FIG. 9 is a perspective view of a fifth embodiment of the present invention.

Referring now to FIG. 9, there is shown yet another embodiment of the subject abdominal exercise system. In this embodiment, abdominal exercise system 50 includes a pair of separate, non-connected engagement bar portions 556*a*, 556*b*. These engagement arm portions 556*a*, 556*b* are directly coupled, respectively, to support members 510 by rigid suspension arm members 552*a*, 552*b*. While not shown, each suspension arm member 552*a*, 552*b* is pivotally coupled in locked manner to a support member 510 using suitable means known in the art.

Figure 10:
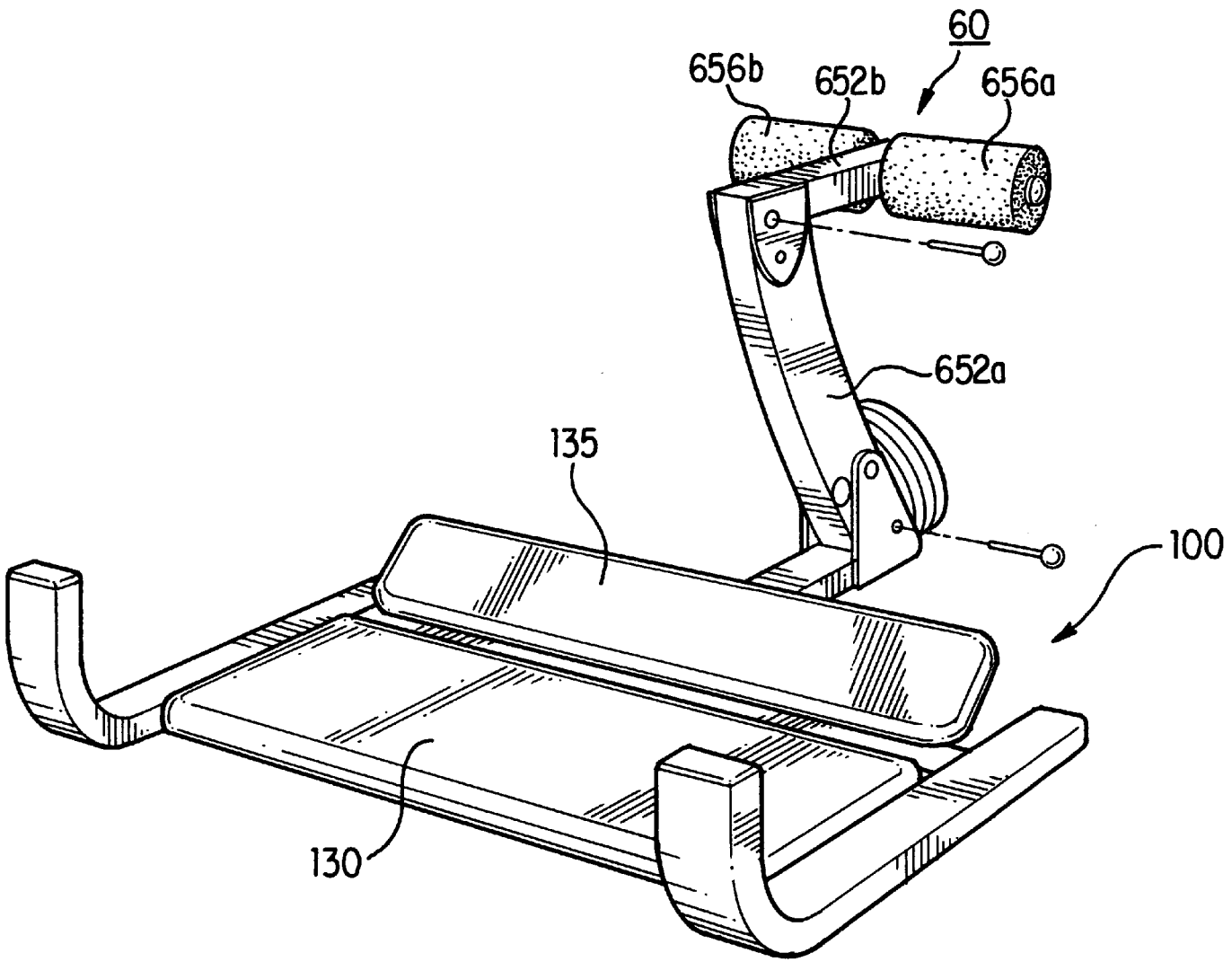
FIG. 10 is a partially exploded perspective view of a sixth embodiment of the present invention.

FIG. 10 shows another alternate embodiment of the subject abdominal exercise system. Abdominal exercise system 60, in this embodiment, includes a first suspension arm section 652*a* pivotally coupled as before in releasably locked manner to base assembly 100. Abdominal exercise system 60, however, employs a second suspension arm section 652*b* pivotally coupled in releasable manner to first suspension arm section 652*a*, which includes only feet-engaging bar portions 656*a*, 656*b*. These engagement bar portions 656*a*, 656*b* are similar in form and function to supplemental engagement bar portions 256*a*, 256*b* in above-described embodiments.

Figure 11:
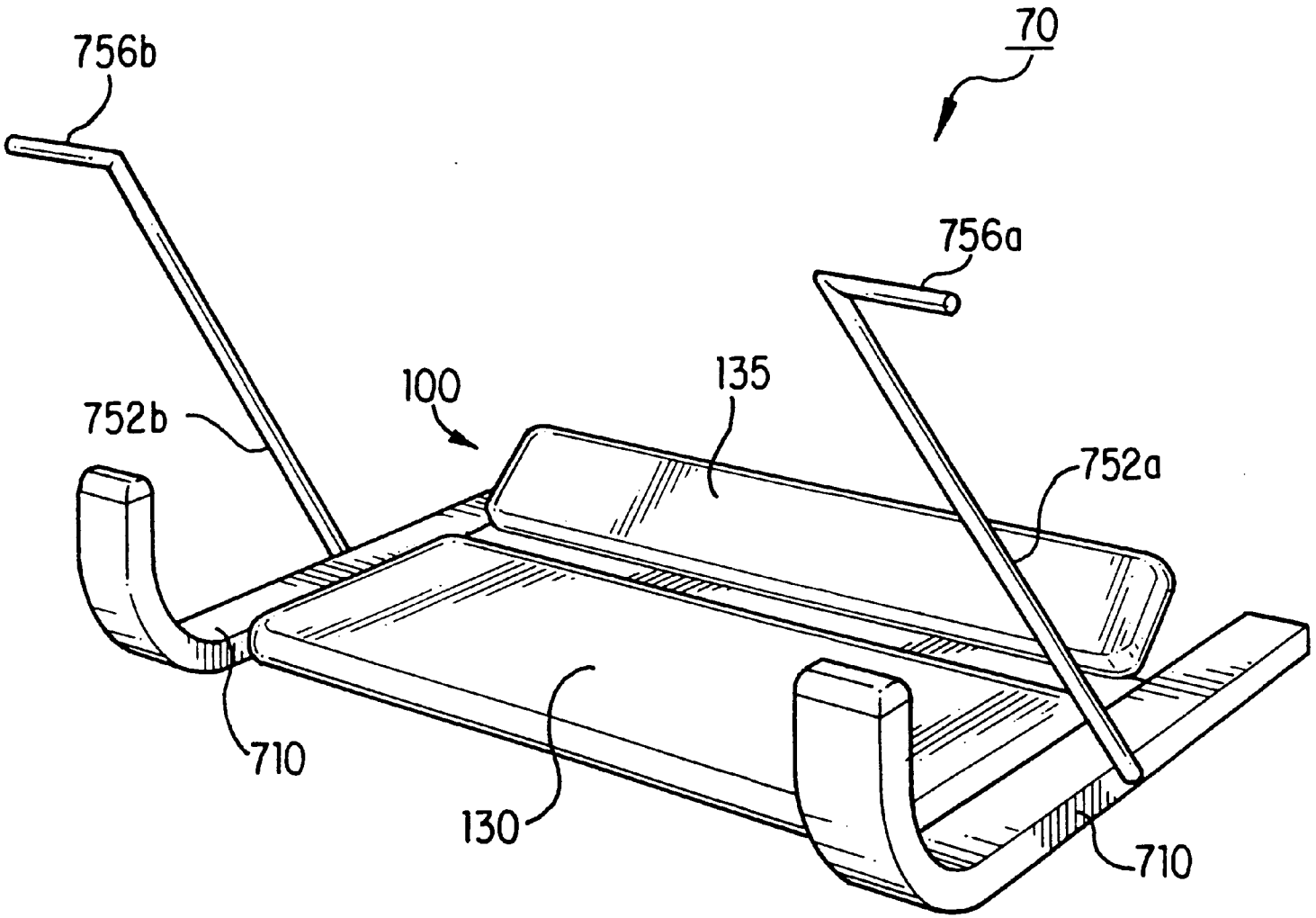
FIG. 11 is a perspective view of a seventh embodiment of the present invention.

Referring to FIG. 11, there is shown another alternate embodiment of the subject abdominal exercise system. In this embodiment, abdominal exercise system 70 includes a pair of engagement bar portions 756*a*, 756*b* which extend laterally outward from the suspension arm members 752*a*, 752*b* which couple them respectively to support members 710. In contrast to the engagement bar portions in above-described embodiments, engagement bar portions 756*a*, 756*b* are intended for engagement by the user's hands rather than his/her knees. This embodiment may prove more useful for those with leg disabilities.

Figure 12:
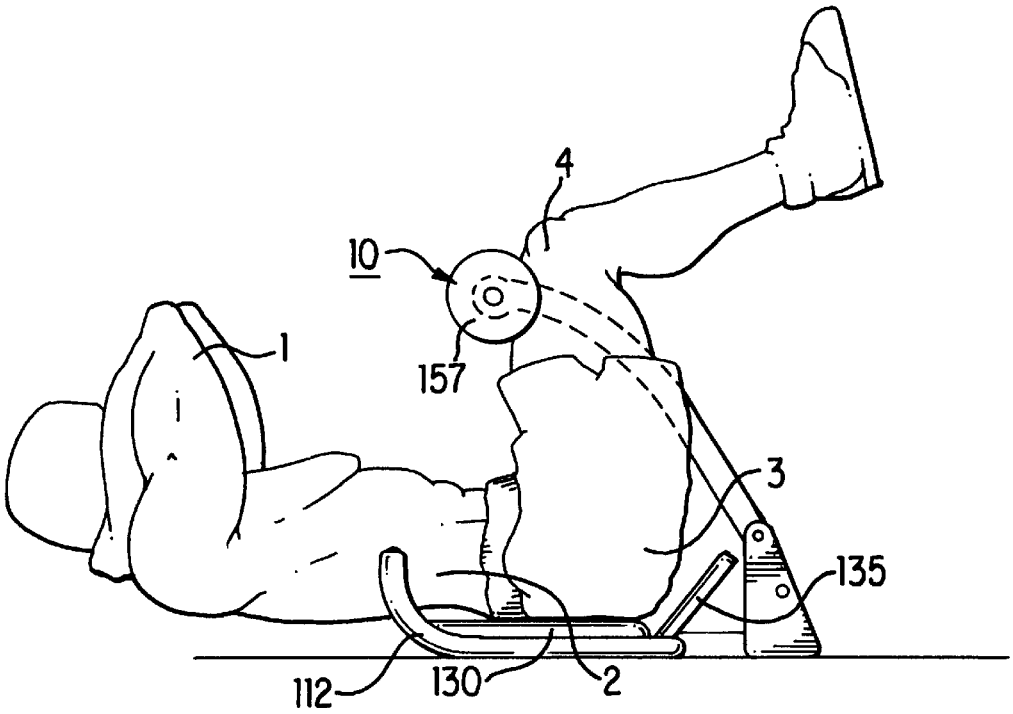
FIG. 12 is an illustrative plan view of the first embodiment of the present invention at a first instant in time during use; and, FIG. 13 is an illustrative plan view of the first embodiment of the present invention at a second instant in time during use.
Figure 13:
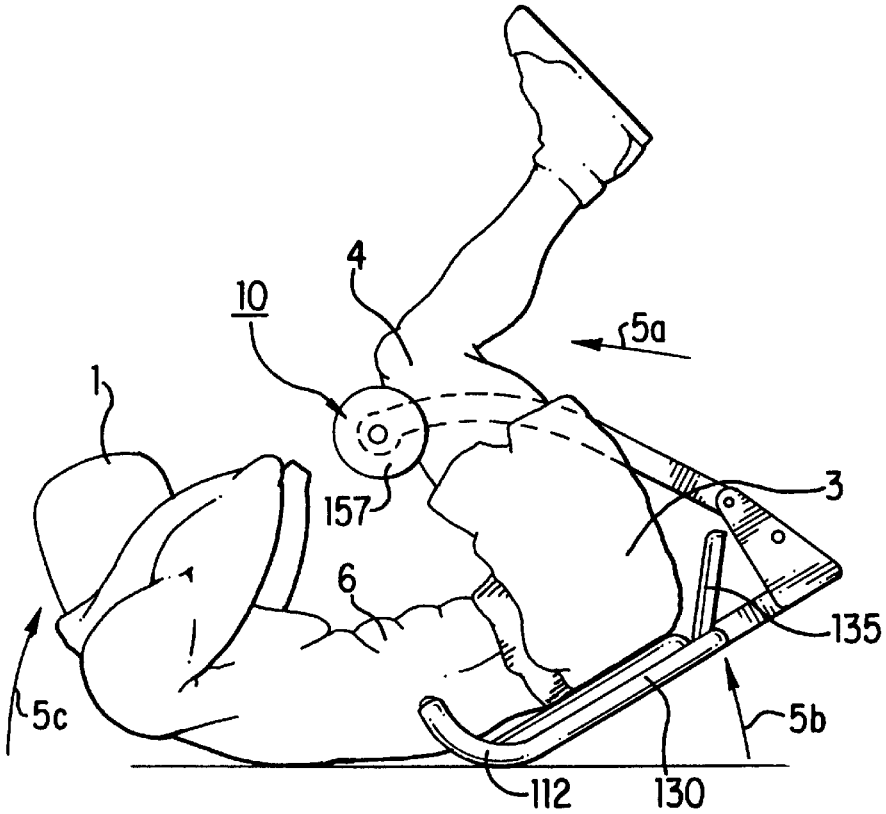

Referring finally to FIGS. 12 and 13, there are shown illustrative views of the subject abdominal exercise system 10 (in the embodiment of FIG. 1) at different points in time during its use by a user 1 to perform an abdominal crunch type exercise. User 1 begins the exercise by initially positioning his body in a generally reclined position such that his pelvic region 3 and a part of his lower back region 2 come to rest on guide panel 130. User 1 then lifts his knees and thighs to bear against engagement bar cushioning sleeves 157. User 1 then proceeds with the exercise by simultaneously drawing his knees towards his chest, as indicated by the directional arrow 5*a*, and curling his abdominal region 6 such that a rocking action occurs on system 10 over elbow portions 112, as indicated by the directional arrow 5*b*. User 1 may rest his head and arms on the underlying surface, or may intensify the exercise by positioning his arms as shown and simultaneously drawing his head upwards, towards his knees, as indicated by the directional arrow 5*c*. User 1 then completes the exercise cycle by relaxing his muscles to return to the initial position shown in FIG. 12.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and variations in the use of the disclosed system may be made from that described herein, all without departing from the spirit or scope of the invention as defined in the appended claims.

What is claimed is:

1. An abdominal exercise system comprising:

(a) a base assembly including a frame formed by a pair of laterally spaced longitudinally extended support members having means located adjacent a proximal end of said frame for facilitating angular displacement of said base assembly substantially as one unit responsive to a predetermined force applied to said abdominal exercise system by a user's legs, said base assembly including a pelvic support coupled between said pair of support members for angular displacement with said frame to supportingly engage and guide the user's pelvic region during said angular displacement of said base assembly, said pelvic support having a substantially planar guide panel portion; and, (b) an engagement assembly coupled to said base assembly for transferring thereto said predetermined force applied by the user's legs, said engagement assembly including (a) a suspension arm coupled to said frame, and (b) an engagement bar coupled to said suspension arm member at a location adjacent said proximal end said frame, said engagement bar having an engagement rod thereon for application of said predetermined force thereto.

2. The abdominal exercise system as recited in claim 1 wherein said angular displacement facilitating means includes an arcuate elbow portion formed on each of said pair of support members adjacent a respective proximal end thereof, said arcuate elbow portions together defining a pivotal axis of said base assembly for said angular displacement thereof.

3. The abdominal exercise system as recited in claim 1 wherein each said support member has an attachment post coupled to a distal end portion thereof for mounting of at least one weight member thereon.

4. The abdominal exercise system as recited in claim 1 wherein said pelvic support includes an inclined stop panel portion coupled to said frame disposed adjacent a distal end pt said guide panel portion for limiting displacement of the user's pelvic region Additive to said frame.

5. The abdominal exercise system as recited in claim 1 further comprising further comprising an attachment post coupled to said engagement assembly for mounting of at least one weight member thereon.

6. The abdominal exercise system as recited in claim 1 wherein said angular displacement facilitating means includes an arcuate elbow portion formed on each of said pair of support members adjacent a respective proximal end thereof and a pair of support stands respectively pivotally coupled to said elbow portions of said pair of support members and defining a pivotal axis of said base assembly.

7. An abdominal exercise system comprising:

(a) a base assembly being angularly displaceable responsive to a predetermined force applied to said abdominal exercise system by a user's legs, said base assembly including:

(1) a pair of laterally displaced support members, each said support member having an arcuate elbow portion disposed adjacent a proximal end of said of said base assembly, said arcuate elbow portions being in contact with a base surface and together define a pivotal axis of said base assembly for said angular displacement thereof; and, (2) a pelvic support extending between said support members for supportingly engaging and guiding the user's pelvic region during said angular displacement of said base assembly, said pelvic support having a substantially planar guide panel portion upon which the user's pelvis region is disposed; and, (b) a collapsible engagement assembly coupled to said base assembly for transferring thereto said predetermined force applied by the user's legs, said engagement assembly including:

(1)a suspension arm member releasably lockingly coupled to said base assembly; and (2) an engagement bar coupled to said supension arm member at a location adjacent said proximal end of said base assembly, said engagement bar having a pair of leg engaging portions for receiving application of said predetermined force.

8. An abdominal exercise system comprising:

(a) a base assembly being angularly displaceable substantially as one unit responsive to a predetermined force applied to said abdominal exercise system by a portion of a user's legs, said base assembly including:

(1) a pair of laterally displaced support members, each said support member having an arcuate elbow portion disposed adjacent a proximal end of said base assembly, said arcuate elbow portions being in contact with a base surface and together define a pivotal axis of said base assembly for said angular displacement thereof, and (2) a pelvic support extending between said support members for supportingly cradling the user's pelvic region during said angular displacement of said base assembly, said pelvic support having a substantially planar guide panel portion disposed adjacent user's pelvic region thereon; and, (b) an engagement assembly coupled to said base assembly for transferring thereto said predetermined force applied by the user, said engagement assembly including:

(1) a suspension arm member coupled to said base assembly and extending therefrom; and, (2) an engagement bar coupled to said suspension member, said engagement bar having a pair of leg engaging portions for receiving application of said predetermined force.

* * * * *